US006186829B1

(12) United States Patent
Murakami et al.

(10) Patent No.: US 6,186,829 B1
(45) Date of Patent: Feb. 13, 2001

(54) WATERPROOF CONNECTOR AND METHOD OF ASSEMBLING THE SAME

(75) Inventors: Takao Murakami; Masaru Fukuda, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/580,553

(22) Filed: May 30, 2000

(30) Foreign Application Priority Data

May 28, 1999 (JP) ..... 11-150303

(51) Int. Cl.[7] ..... H01R 13/40
(52) U.S. Cl. ..... 439/587; 439/274; 439/275
(58) Field of Search ..... 439/587, 271, 439/274, 275, 279, 589

(56) References Cited

U.S. PATENT DOCUMENTS

| | | | | |
|---|---|---|---|---|
| 5,356,312 | * | 10/1994 | Abe et al. | 439/279 |
| 5,607,318 | * | 3/1997 | Wakata et al. | 439/275 |
| 5,897,396 | * | 4/1999 | Maejima | 439/275 |
| 6,033,261 | * | 3/2000 | Wakata et al. | 439/587 |
| 6,039,603 | * | 3/2000 | Wakata et al. | 439/587 |
| 6,102,740 | * | 8/2000 | Murakami et al. | 439/587 |

FOREIGN PATENT DOCUMENTS

| | | |
|---|---|---|
| 0 844 693 A2 | 5/1998 | (EP) . |
| 0 942 494 A2 | 9/1999 | (EP) . |
| 2 308 928 | 7/1997 | (GB) . |
| 11-329571 | 11/1999 | (JP) . |
| 11-354200 | 12/1999 | (JP) . |
| 97/36346 | 10/1997 | (WO) . |

OTHER PUBLICATIONS

Patent Abstract of Japan 11354200 Dec. 24, 1999.

* cited by examiner

*Primary Examiner*—Paula Bradley
*Assistant Examiner*—Tho D. Ta
(74) *Attorney, Agent, or Firm*—Sughrue, Mion, Zinn, Macpeak & Seas, PLLC

(57) ABSTRACT

A waterproof rubber plug has a through hole through which an electric wire is inserted. A terminal to which the electric wire is connected has a clamping member for clamping one end portion of the rubber plug. An inner housing has a terminal chamber for accommodating the terminal. An outer housing having sidewalls for defining a chamber provided with a bottom wall, into which the inner housing is fitted. A through hole, through which the electric wire is inserted, is formed on the bottom wall so as to face the terminal chamber when the inner housing is inserted into the chamber of the outer housing. A recess is formed on the bottom wall so as to communicate with the through hole in order to accommodate the rubber plug when the inner housing is completely fitted into the chamber of the outer housing, thereby sealing the electric wire and the terminal chamber.

3 Claims, 9 Drawing Sheets

PRIOR ART

PRIOR ART

PRIOR ART

PRIOR ART

PRIOR ART

WATERPROOF CONNECTOR AND METHOD OF ASSEMBLING THE SAME

BACKGROUND OF THE INVENTION

The present invention relates to a small size multi-way water proof connector with an improved water proof property between a connector housing and a plurality of electric wires connected with terminals, and a method of assembling the same.

A related waterproof connector, which is disclosed in Japanese Patent Publication No. 11-329571A, will be explained specifically with reference to FIGS. 2 to 4E. A connector housing 11 of a water proof connector 10' comprises a synthetic resin inner housing 12 having a plurality of terminal chambers 13 formed integrally therewith, a synthetic resin outer housing 17 for fitting the inner housing 12 to the inside thereof, and a synthetic resin spacer 28 disposed between the inner housing 12 and the outer housing 17 for holding female terminals 14 accommodated in each terminal chamber 13 of the inner housing 12. p As shown in FIGS. 2 and 3, the inner housing 12 has a box part 12*a* with the rear side of the upper and lower faces opened, for forming the terminal chambers 13 in a space formed with the center horizontal wall 12*b* and vertical side walls 12*c*, serving also as partition walls in the vertical direction. The female terminals 14 can be accommodated in each terminal chamber 13. Moreover, engagement claws 15 are formed integrally, projecting from both sides and the center of the upper and lower faces of the box part 12*a* as well as flange parts 16 are formed integrally projecting from the front end of the both side center parts. Rectangular insertion holes 12*d* through which female terminals of a mating connector (not illustrated) are inserted are formed in the front wall of the box part 12*a* at a position corresponding to each terminal chamber 13. Furthermore, a pair of press-connecting blades 14*b*, 14*b* are formed by bending each in both side plate parts in the rear part of a box part 14*a* of the female terminals.

As shown in FIGS. 2 and 3, the outer housing 17 has a double box-like shape with the front side opened, with a substantially quadrilateral pipe-like inner wall part 17*a*, a substantially quadrilateral pipe-like outer wall part 17*b* for containing the inner wall part 17*a*, and a bottom wall part 17*c*, connecting the rear parts of the inner and outer wall parts 17*a*, 17*b*. A thick portion is provided in the center of the bottom wall part 17*c*. Rubber plug chambers 19 having a large diameter round cross-section for storing the water proof rubber plugs 18 by press-in are formed at a position corresponding to each terminal chamber 13 at the front side with respect to the thick portion as well as insertion holes 21 having a small diameter round cross-section for inserting electric wires 20 therethrough are formed, communicating with each corresponding rubber plug chamber 19 at the rear side with respect to the thick portion. The water proof rubber plugs 18 have a substantially cylindrical shape with the rugged inner and outer circumferential faces so that the electric wires 20 can be inserted through the inside thereof without having a gap.

Moreover, rectangular engagement holes 22 to be engaged with each engagement claw 15 at both sides of the upper and lower faces of the box part 12*a* of the inner housing 12 are formed at both front sides of the upper and lower walls of the inner wall part 17*a* of the outer housing 17 as well as rectangular longitudinal engagement holes 23 to be engaged with each engagement claw 15 at the center of the upper and lower faces of the box part 12*a* of the inner housing 12 are formed at the front center portion of the upper and lower walls of the inner wall part 17*a*. Furthermore, a V-shaped packing receiving part 25 for receiving an annular rubber water proof packing 24 is formed integrally, projecting from the deep part of the outer face side of the inner wall part 17*a* of the outer housing 17. Tapered faces 26 are formed in the front rim of the inner face side of the inner wall part 17*a* of the outer housing at a position corresponding to each engagement hole 22, 23. Moreover, engagement holes 27 to be engaged with flexible engagement arms of a mating connector (not illustrated) are formed at the front side of the upper and lower walls of the outer wall part 17*b* of the outer housing 17.

As shown in FIGS. 2 and 3, the spacer 28 forms a box-like shape with the front side opened, with a substantially quadrilateral pipe-like body 28 to be fitted with the inner face side of the inner wall part 17*a* of the outer housing 17, a substantially quadrilateral pipe-like brim part 28*b* formed integrally with the front end of the body 28*a*, bent rearward therefrom, to be fitted with the outer face side of the inner wall part 17*a* of the outer housing, and a bottom wall part 28*c* of the body 28*a*.

Accordingly, the box part 12*a* of the inner housing 12 can be fitted into the body 28*a* of the spacer 28. Rib-like projections 29 for preventing fall-off of the terminals are formed integrally, projecting from the inner face of the upper and lower walls of the body 28*a* of the spacer 28, to be engaged with the rear end rim of the box part 14*a* of the female terminals 14 accommodated in each terminal chamber 13.

Moreover, notch portions 30, 31 are formed in the front side of the portion connecting the body 28*a* and the brim part 28*b* of the spacer 28 at a position corresponding to each of the engagement claw 15 and the flange part 16 of the inner housing 12. Engagement claws 32 to be engaged with each engagement hole 23 of the outer housing 17 are formed integrally, projecting form the outer face side of the upper and lower walls of the body 28*a* of the spacer 28 between the upper and lower side notch portions 30. Furthermore, the tip portion of the brim part 28*b* can hold the packing 24 engaged with the packing receiving part 25 of the inner wall part 17*a* of the outer housing 17 when the fitting operation with respect to the outer housing 17 is completed.

Moreover, insertion holes 33 are formed in the bottom wall part 28*c* of the spacer 28 at a position corresponding to each insertion hole 21 of the outer housing 17. Furthermore, the bottom wall part 28*c* of the spacer 28 can hold the rubber plugs 18 inserted in each rubber plug chamber 19 of the bottom wall part 17*c* of the outer housing when the fitting operation with respect to the outer housing 17 is completed. As shown in FIG. 2, each electric wire 20 inserted through each insertion hole 21 of the outer housing 17, each rubber plug 18 and each insertion hole 33 of the spacer 28 is press-connected between the pair of the press-connecting blades 14*b*, 14*b* of each female terminal accommodated in each terminal chamber 13 of the inner housing 12 so that each terminal chamber 13 and each electric wire 20 are sealed with the rubber plug 18 and the packing 24, respectively.

In assembling the water proof connector 10' with the above-mentioned configuration, as shown in FIG. 4A, the rubber plugs 18 are inserted and set in each rubber plug chamber 19 inside the bottom wall part 17*c* of the outer housing 17 comprising the outside of the connector housing 11 from the connector housing fitting direction as well as the packing 24 is inserted and set in the packing receiving part 25 of the inner wall part 17*a* of the outer housing 17.

Then, as shown in FIG. 4B, the body 28*a* of the spacer 28 is fitted into the inner wall part 17*a* of the outer housing 17 so that each engagement claw 32 of the body 28*a* of the spacer 28 is engaged with each engagement hole 23 of the inner wall part 17*a* of the outer housing 17. According to the engagement of each engagement hole 23 of the inner wall part 17*a* of the outer housing 17 and each engagement claw 32 of the body 28*a* of the spacer 28, fall-off of each rubber plug 18 is prevented by the bottom wall part 17*c* of the outer housing 17 as well as fall-off of the packing 24 is prevented by the oblique tip end of the brim part 28*b* of the spacer 28 so that the water proof property of the connector housing as a whole can further be improved.

As shown in FIG. 4C, the electric wires 20 are inserted through each insertion hole 21 of the bottom wall part 17*c* of the outer housing 17, each rubber plug 18, and each insertion hole 33 of the bottom wall part 28*c* of the spacer 28 from the outside. Then, as shown in FIG. 4D, each electric wire 20 is press-connected with the pair of the press-connecting blades 14*b*, 14*b* of the female terminals 14 accommodated in each terminal chamber 13 of the inner housing 12 comprising the inner side of the connector housing 11.

As shown in FIG. 4E, the inner housing 12 is fitted into the body 28*a* of the spacer 28 so that each engagement claw 15 of the box part 12*a* of the inner housing 12 is engaged with each engagement hole 23 of the inner wall part 17*a* of the outer housing 17 so as to complete the assembly of the water proof connector 10'. At the time, since the rear end rim of the box part 12*a* of the inner housing 12 and the rear end rim of the box part 14*a* of the female terminals 14 accommodated in each terminal chamber 13 are locked according to each projection 29 projecting to the inner face of the upper and lower walls of the body 28*a* of the spacer 28 as well as each projection 29 cannot deform outward, fall-off of the female terminals 14 from each terminal chamber can be prevented certainly. Besides, since the spacer 28 can hold each female terminal 14 and each rubber plug 18 at the same time, a component dedicated to prevention of fall-off of the rubber plug can be eliminated, and thus a low cost can be achieved by cutback of the number of the components. Furthermore, since the spacer 28 can be locked doubly according to the engagement of each engagement claw 32 of the spacer 28 itself with each engagement hole 23 of the outer housing 17 and the engagement of each engagement claw 15 o the inner housing 12 with each engagement hole 23 of the outer housing 17, fall-off of each rubber plug 18 and the packing 24 can be prevented certainly so that the water proof reliability can further be improved.

However, according to the related water proof connector 10', since the rubber plugs 18 are accommodated preliminarily in the rubber plug chambers 19 of the outer housing 17 as shown in FIG. 4B, the electric wires 20 can easily be bent due to the sliding friction between the rubber plugs 18 and the electric wires as shown in FIG. 5 at the time of the electric wire insertion by inserting the electric wires 20 through the insertion holes 21 of the outer housing 17 and the insertion holes 33 of the spacer 28 shown in FIGS. 4B to 4C, and at the time of fitting the housing by sliding the electric wires 20 with respect to the insertion holes 33 of the spacer 28 and the insertion holes 21 of the outer housing 17 so as to fit the inner housing 12 into the spacer 28 fitted inside the outer housing 17 shown in FIGS. 4D to 4E so that there is a risk of causing a trouble in the wire harness production. That is, there is a risk of deteriorating the assembly operativity of the water proof connector 10' due to the increased operation load by the sliding friction between the rubber plugs 18 and the electric wires 20 at the time of the electric wire inserting operation of the electric wires 20 and the housing fitting operation of fitting the inner housing 12 into the outer housing 17 side.

Moreover, since the function of preventing the fall-off of the rubber plugs 18 is provided to the spacer 28, the longitudinal body 28*a* for integrally forming the bottom wall part 28*c* for holding the rubber plugs 18 is indispensable in the spacer 28, resulting in bulkiness of the water proof connector 10'.

SUMMARY OF THE INVENTION

Accordingly, in order to solve the above-mentioned problems, an object of the invention is to provide a small size multi-way water proof connector with an improved assembly operativity, and a method of assembling the same.

In order to achieve the above object, according to the present invention, there is provided a waterproof connector comprising:

- a waterproof rubber plug having a through hole through which an electric wire is inserted;
- a terminal to which the electric wire is connected having a clamping member for clamping one end portion of the rubber plug;
- an inner housing having a terminal chamber for accommodating the terminal;
- an outer housing having sidewalls for defining a chamber provided with a bottom wall, into which the inner housing is fitted;
- a through hole, through which the electric wire is inserted, formed on the bottom wall so as to face the terminal chamber when the inner housing is inserted into the chamber of the outer housing; and a recess formed on the bottom wall so as to communicate with the through hole in order to accommodate the rubber plug when the inner housing is completely fitted into the chamber of the outer housing, thereby sealing the electric wire and the terminal chamber.

According to the above configuration, since the rubber plug can be fixed to the terminal at the time of connecting the electric wire inserted through the insertion hole of the outer housing and the rubber plug with the terminal accommodated in the terminal chamber of the inner housing, the friction between the electric wire and the rubber plug can be eliminated at the time of fitting the inner housing into the chamber of the outer housing so as to prevent generation of bend of the electric wires, and thus the assembly operativity of the water proof connector can be improved. That is, production of the wire harness can be facilitated.

Preferably, the waterproof connector further comprises:

- a waterproof packing member attached on an outer peripheral face of the side walls of the outer housing; and
- a spacer engaged with the side walls to hold the packing member thereon.

According to the above configuration, since the rubber plug is fixed to the terminals, the portion provided with the function of preventing the fall-off of the rubber plugs can be eliminated from the spacer for holding the water proof packing. Therefore, a small size of the water proof connector can be achieved for the eliminated space.

According to the present invention, the above waterproof connector is assembled by the steps of:

- passing the electric wire through the through hole on the bottom wall of the outer housing;

passing the electric wire through the through hole of the rubber plug;

connecting the electric wire to the terminal while holding one end portion of the rubber plug by the clamping member of the terminal;

fitting the terminal into the terminal chamber of the inner housing; and pulling the electric wire toward the bottom wall such that the inner housing is fitted into the chamber of the outer housing and thereby the rubber plug is fitted into the recess of the outer housing.

According to the above configuration, since the friction is not generated between the electric wire and the rubber plug due to pressure on the rubber plug at the time of inserting the electric wire through the insertion hole of the outer housing and at the time of fitting the inner housing into the chamber of the outer housing, the assembly can be executed smoothly without generation of bend of the electric wire so as to alleviate the operation load (electric wire insertion force and housing fitting force). Accordingly, a water proof connector having the excellent water proof property can be assembled easily in a short time, and thus the assembly operativity as a whole can further be improved.

DETAILED DESCRIPTION OF THE PREFERRED EMBODIMENTS

Figure 1:
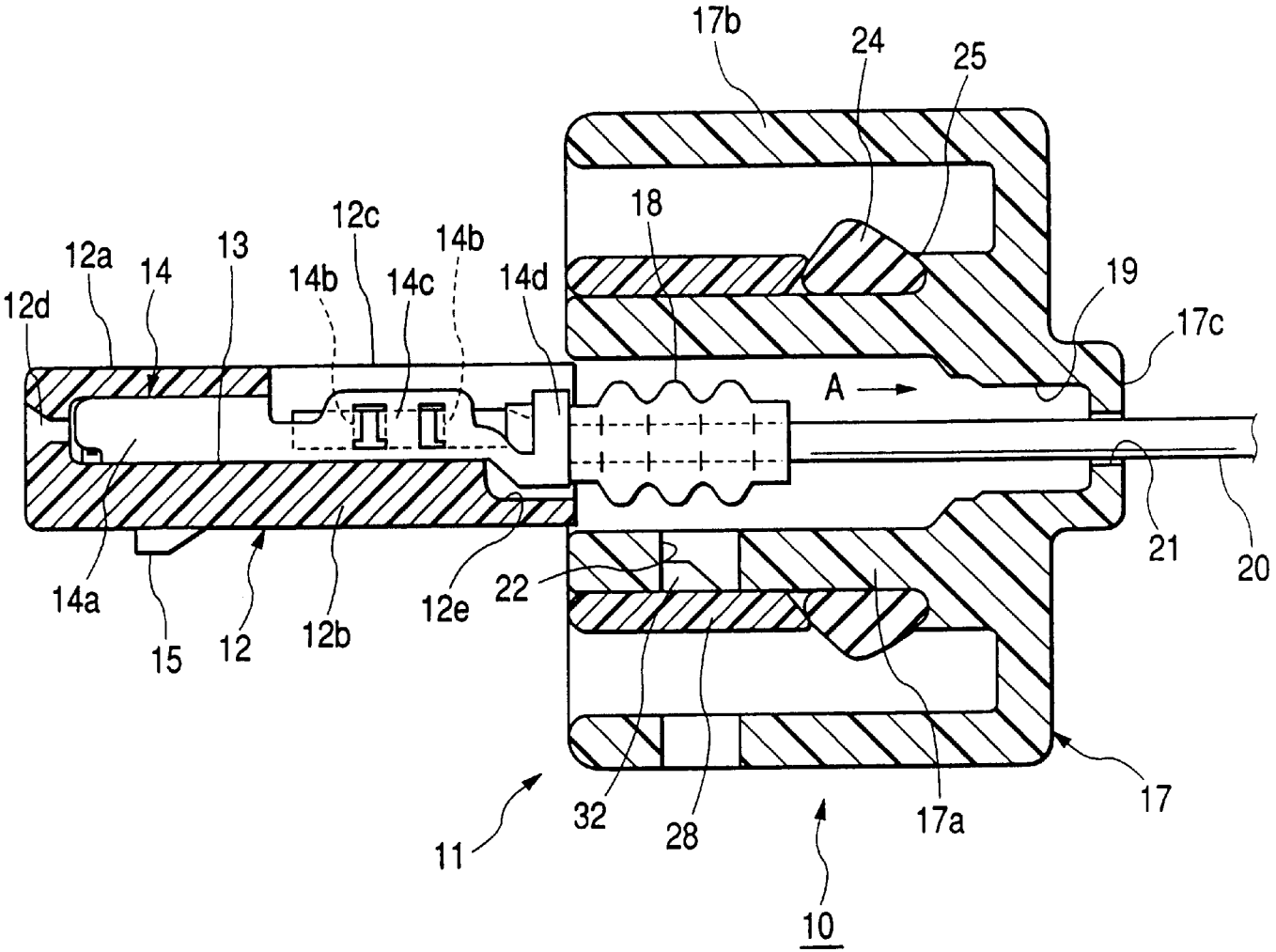
FIG. 1 is a cross-sectional view showing a water proof connector according to an embodiment of the invention in a state before assembled.

Hereinafter an embodiment of the invention will be explained with reference to the drawing.

FIG. 1 is a cross-sectional view showing a water proof connector according to an embodiment of the invention in a state of before assembled.

As shown in FIG. 1, similar to the case of the related waterproof connector, a connector housing 11 of a water proof connector 10 comprises a synthetic resin inner housing 12 having a plurality of terminal chambers 13 formed integrally therewith, a synthetic resin outer housing 17 for fitting the inner housing 12 to the inside thereof, and a synthetic resin spacer 28 to be fitted into the outer housing 17 for holding a water proof packing 24 for sealing a mating connector (not illustrated). The same components as in the related water proof connector 10' are applied with the same numerals.

The inner housing 12 has a box part 12*a* with the rear side of the upper face opened, for forming the terminal chambers 13 adjacent horizontally with each other in a space formed with a horizontal wall 12*b* and vertical side walls 12*c*, serving also as partition walls. The press-connection type female terminals 14 can be accommodated in each terminal chamber 13. Moreover, engagement claws 15 are formed integrally, projecting from both sides of the lower face of the box part 12*a*. Rectangular insertion holes 12*d* for inserting female terminals of a mating connector (not illustrated) therethrough are formed in the front wall of the box part 12*a* at a position corresponding to each terminal chamber 13. Furthermore, a recess 12*e* is formed at the rear part of the bottom wall 12*b* of the box part 12*a*.

The female terminals 14 comprise a box part 14*a* for inserting a male terminal of a mating connector therethrough so as to be contacted, both side plate parts 14*c*, 14*c*, formed integrally with the rear part of the box part 14*a*, with a pair of press-connecting blades 14*b* formed so as to face with each other by bending inward, and a rubber plug clamping part 14*d* with a substantially U-shaped plan view, formed integrally with the rear end of both side plate parts 14*c* for pressing and fixing the outer peripheral front side of the rubber plugs 18. The rubber plug clamping part 14*d* of the female terminals 14 is disposed inside the recess 12*e* of the bottom wall 12*b* at the time the female terminals 14 are accommodated in the terminal chambers 13 of the inner housing 12.

The outer housing 17 has a double box-like shape with the front side opened, with a substantially quadrilateral pipe-like inner wall part 17*a*, a substantially quadrilateral pipe-like outer wall part 17*b* for containing the inner wall part 17*a*, and a bottom wall part 17*c*, connecting the rear parts of the inner and outer wall parts 17*a*, 17*b*. A thick portion is provided in the center of the inner wall part 17*a* toward the bottom wall part 17*c* side. Rubber plug chambers 19 having a large diameter round cross-section for storing the water proof rubber plugs 18 by press-in are formed at a position corresponding to each terminal chamber 13 at the front side with respect to the thick portion as well as insertion holes 21 having a small diameter round cross-section for inserting electric wires 20 therethrough are formed in the bottom wall part 17*c*, communicating with each corresponding rubber plug chamber 19.

Moreover, rectangular engagement holes 22 to be engaged with each engagement claw 15 at both sides of the lower face of the box part 12*a* of the inner housing 12 are formed at both front sides of the lower wall of the inner wall part 17*a* of the outer housing 17. Furthermore, a V-shaped packing receiving part 25 for receiving a rubber ring-like water proof packing 24 is formed integrally, projecting from the deep part of the outer face side of the inner wall part 17*a* of the outer housing 17.

The water proof rubber plugs 18 to be accommodated in the rubber plug chambers 19 of the outer housing 17 have a substantially cylindrical shape with the rugged inner and outer circumferential faces so that the electric wires 20 can be inserted through the inside thereof without having a gap. Moreover, when the electric wires 20 inserted through each electric terminal insertion hole 21 of the outer housing 17 and the rubber plugs 18 are press-connected with each pair of the press-connecting blades 14*b* of the female terminals 14 accommodated in each terminal chamber 13 of the inner housing 12, the front side of the outer peripheral face of the rubber plugs 18 is pressed and fixed to the rubber plug clamping parts 14*d* of the female terminals 14 at the same time.

The spacer 28 has a substantially quadrilateral pipe-like shape to be fitted onto the outer face side of the inner wall part 17*a* of the outer housing 17. Moreover, an engagement claw 32 to be engaged with each engagement hole 22 of the outer housing 17 is formed integrally, projecting from the inner face of the spacer 28. The tip end part of the spacer 28 holds the packing 24 engaged with the packing receiving part 25 of the inner wall part 17*a* of the outer housing 17 when the fitting operation to the outer housing 17 is completed.

In assembling the water proof connector 10 of this embodiment, the water proof packing 24 is inserted and set preliminarily into the packing receiving part 25 of the inner wall part 17*a* of the outer housing 17 comprising the outer side of the connector housing 11 via the spacer 28. The electric wires 20 are inserted through a plurality of the insertion holes 21 of the bottom wall part 17*c* of the outer housing 17 from the outside thereof, and each of them is inserted through the rubber plugs 18. Each electric wire 20 is press-connected with the pair of the press-connecting blades 14*b* of each female terminal 14 accommodated in a plurality of the terminal chambers 13 of the inner housing 12 comprising the inner side of the connector housing 11. Simultaneously with the press-connecting, the front side of the outer peripheral face of the rubber plugs 18 is pressed and fixed to the rubber plug clamping part 14*d* of each terminal 14 by caulking.

As shown in FIG. 1, the rubber plugs 18 are accommodated with pressure in each rubber plug chamber 19 inside the bottom wall part 17*c* of the outer housing 17 by pulling each electric wire 20 to outside direction outside the outer housing 17 shown by the arrow A as well as the inner housing 12 is fitted into the inner wall part 17*a* of the outer housing 17. Accordingly, assembly of the water proof connector 10 with each electric wire 20 sealed with each rubber plug 18 can be completed.

Accordingly, since the inner housing 12 is fitting into the inside of the outer housing 17 by pulling each electric wire 20 in the direction outside the outer housing 17 shown by the arrow A after press-connecting with the pair of the press-connecting blades 14*b* of each female terminal 14 accommodated in each terminal chamber 13 of the inner housing 12 as well as pressing and fixing the rubber plugs 18 to the rubber plug clamping part 14*d* of each female terminal 14 at the same time, since the friction is not generated between the electric wires 20 and the rubber plugs 18 due to pressure on the rubber plugs 18 at the time of inserting the electric wires 20 through each insertion hole 21 of the outer housing 17 and at the time of fitting the inner housing 12 into the inside of the outer housing 17, the electric wires 20 can be assembled smoothly without generation of bend so as to alleviate the operation load of the electric wire insertion force and the housing fitting force. Accordingly, a multi-way water proof connector 10 having the excellent water proof property can be assembled easily in a short time. That is, since production of a wire harness comprising a bundle of the electric wires 20 can be facilitated, and thus the assembly operativity as a whole can further be improved.

Figure 2:
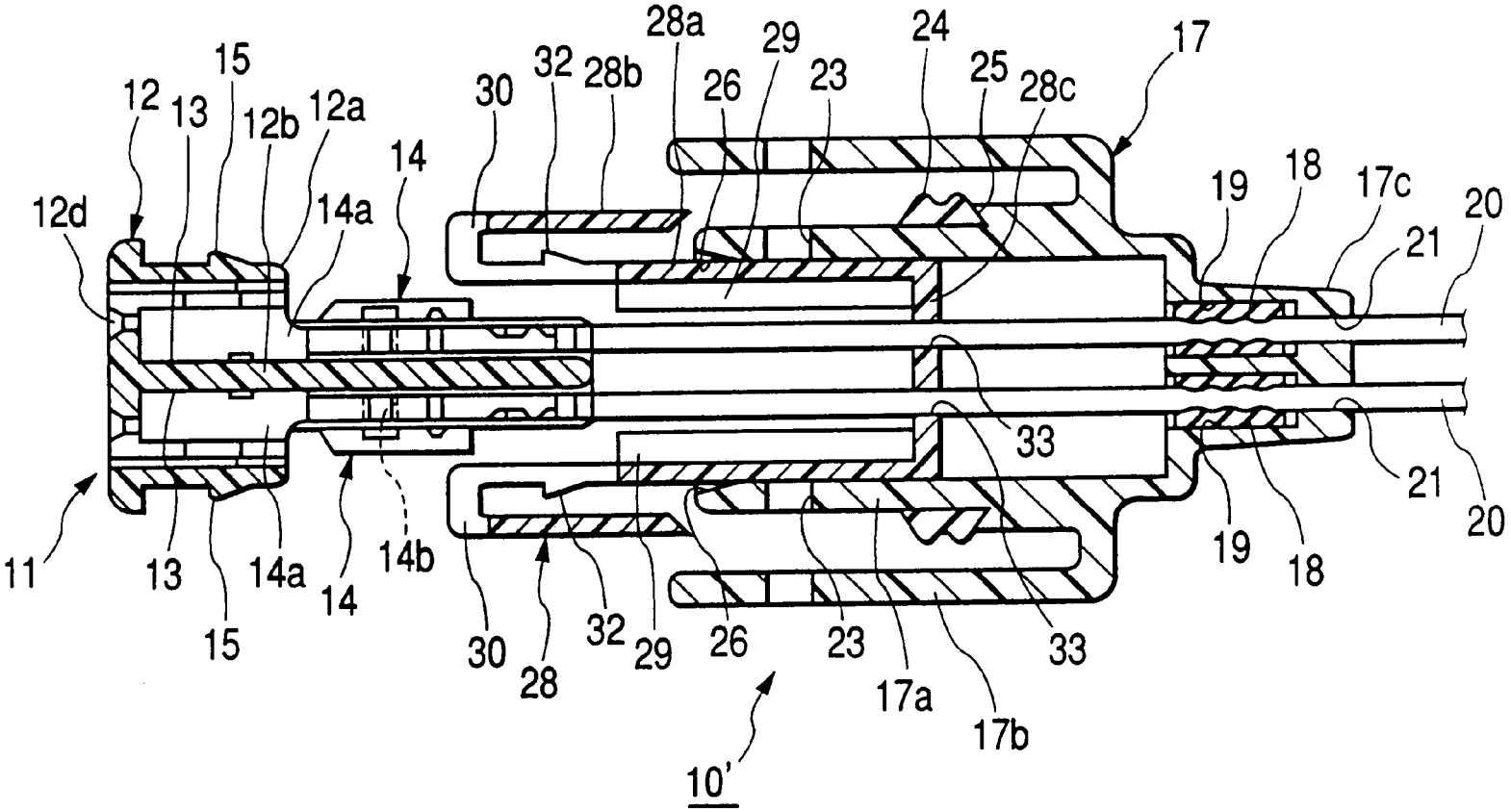
FIG. 2 is a cross-sectional view of a related water proof connector in a state before assembled.
Figure 3:
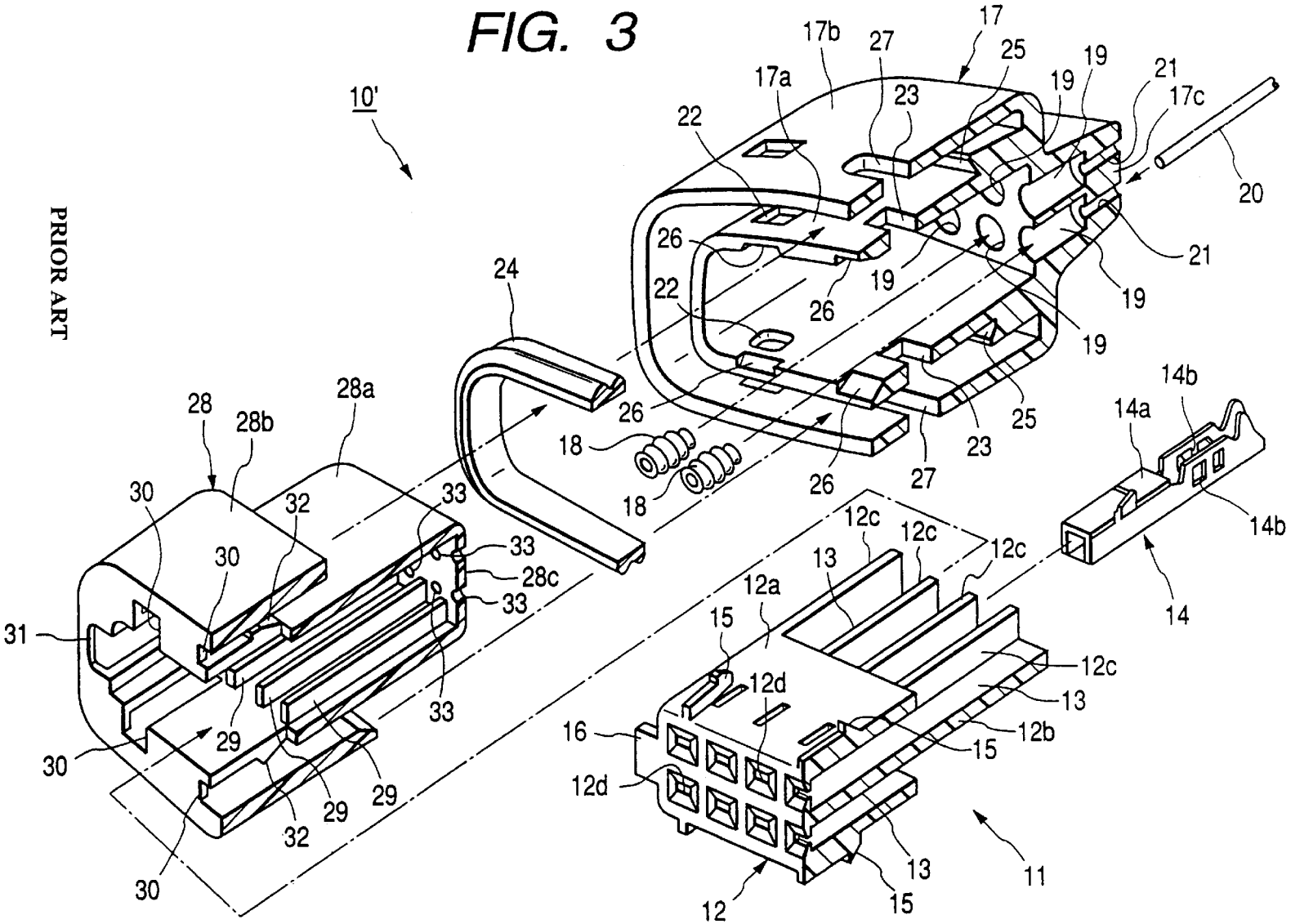
FIG. 3 PRIOR ART
FIG. 3 is a perspective view with a partial cross-section of FIG. 2.
Figure 4A:
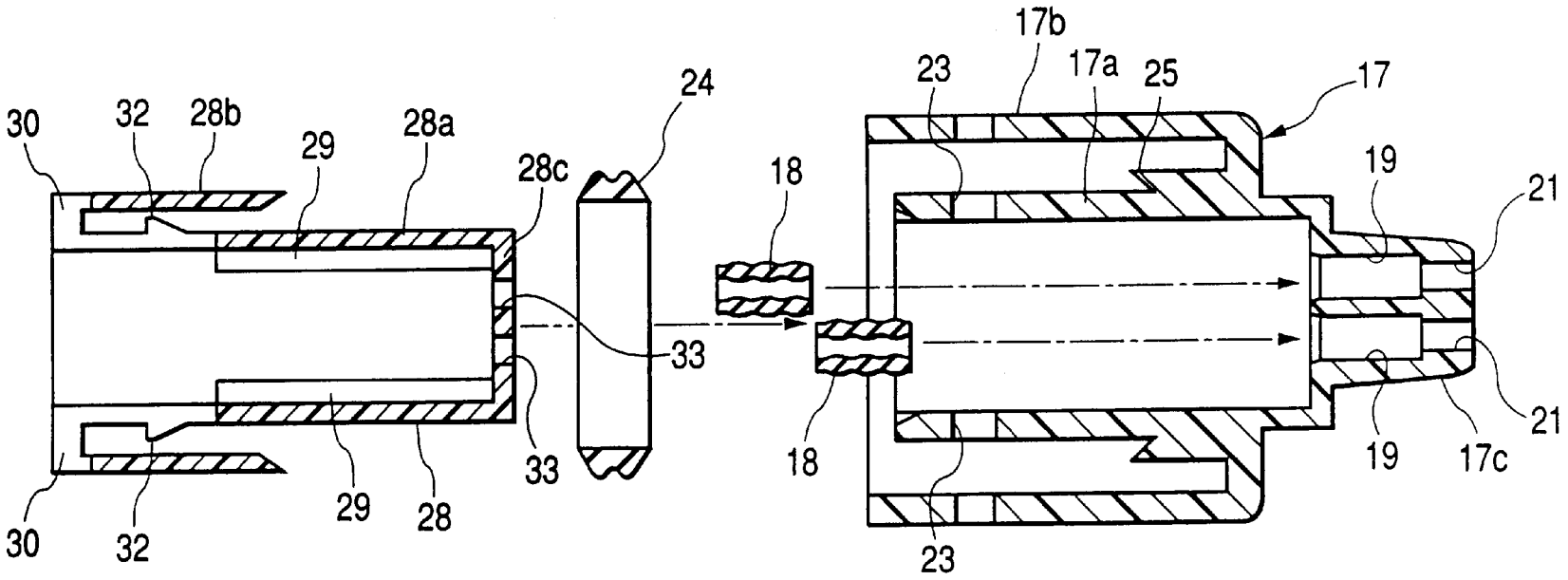
FIG. 4A is a cross-sectional view of the related water proof connector in the state before assembled.
Figure 4B:
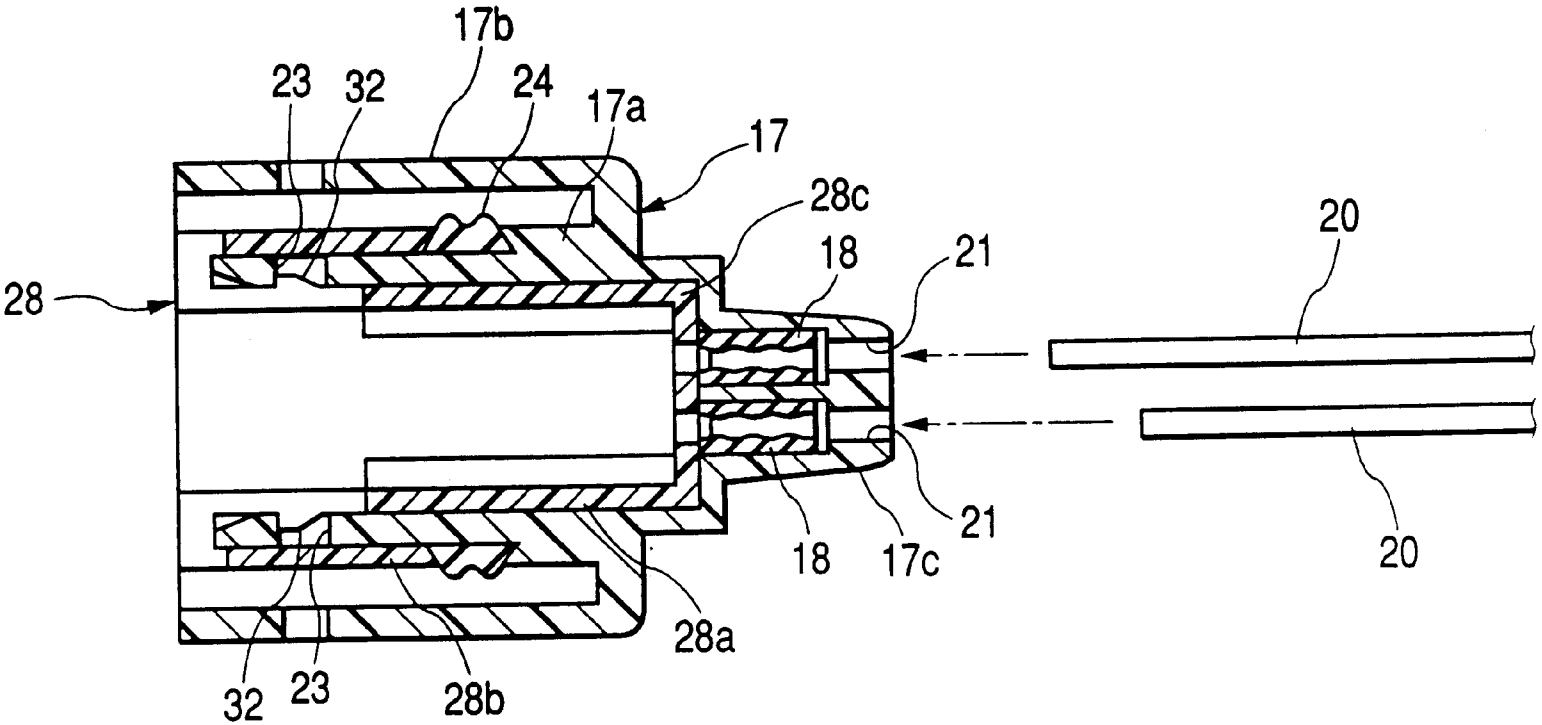
FIG. 4B is a cross-sectional view of the related water proof connector showing a state with a spacer fitted in an outer housing.
Figure 4C:
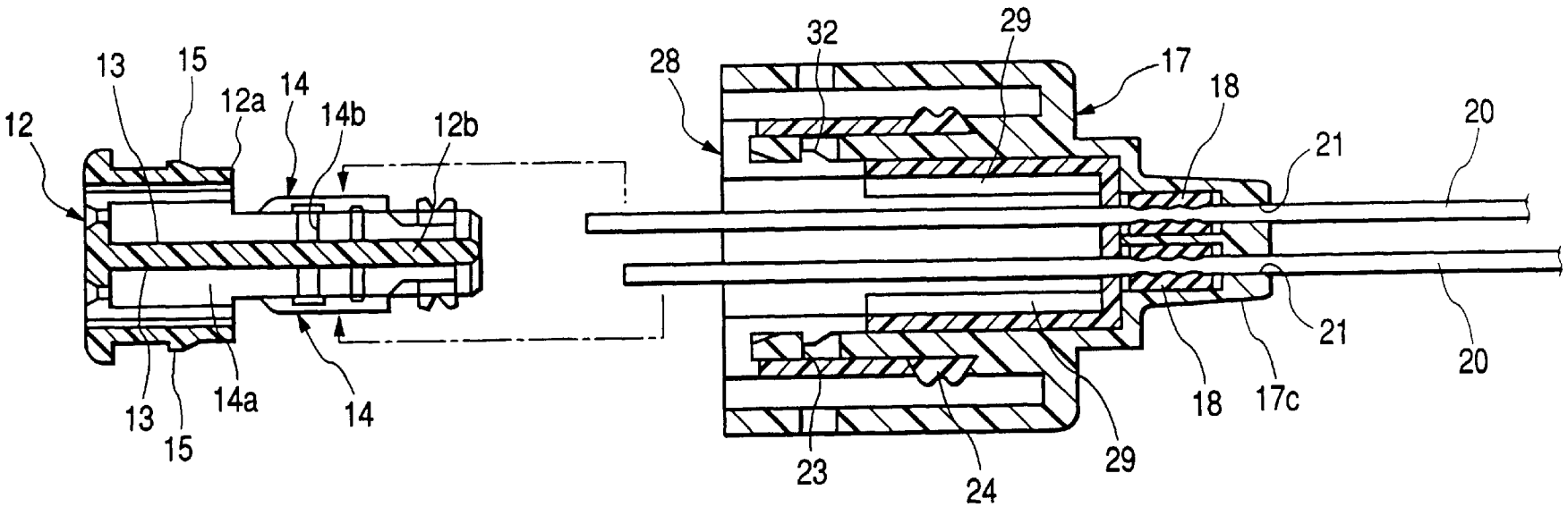
FIG. 4C PRIOR ART
FIG. 4C Is a cross-sectional view showing a state with electric wires inserted through and outer housing and the spacer.
Figure 4D:
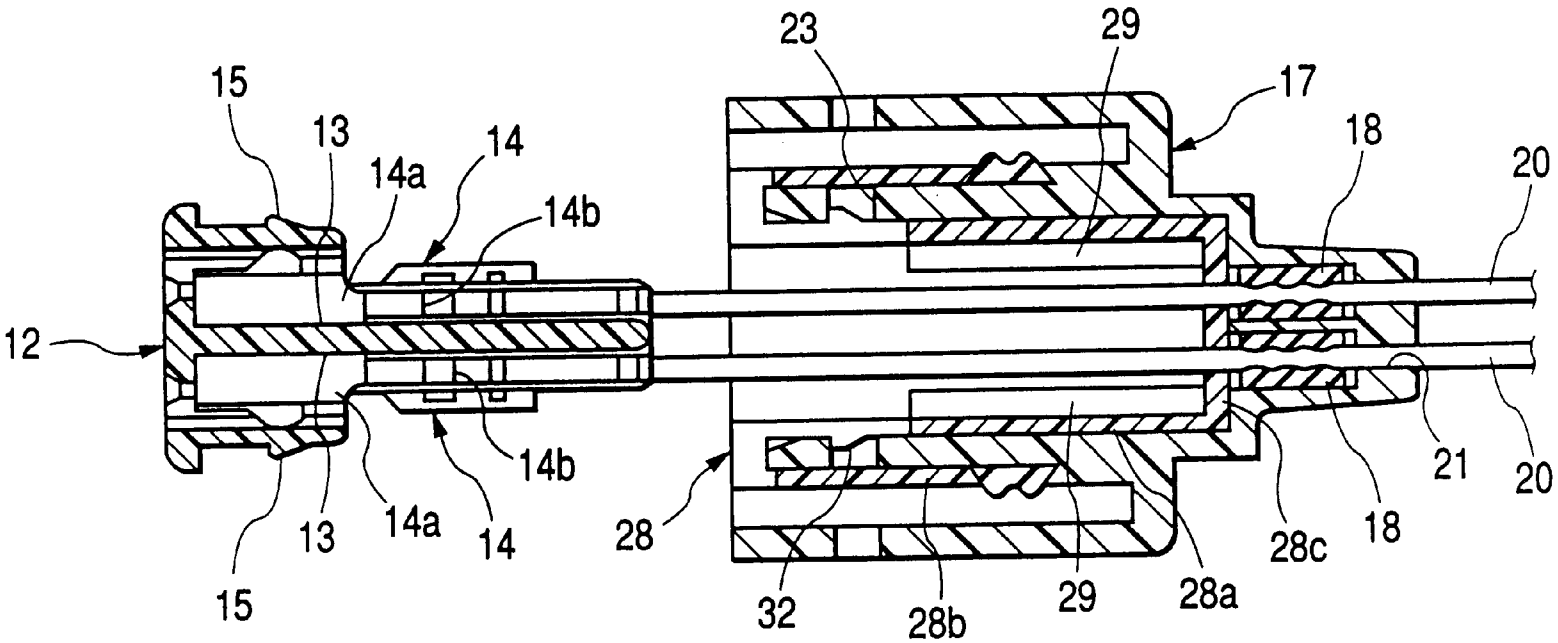
FIG. 4D PRIOR ART
FIG. 4D is a cross-sectional view showing a state with the electric wires connected with terminals accommodated in terminal chambers of an inner housing.
Figure 4E:
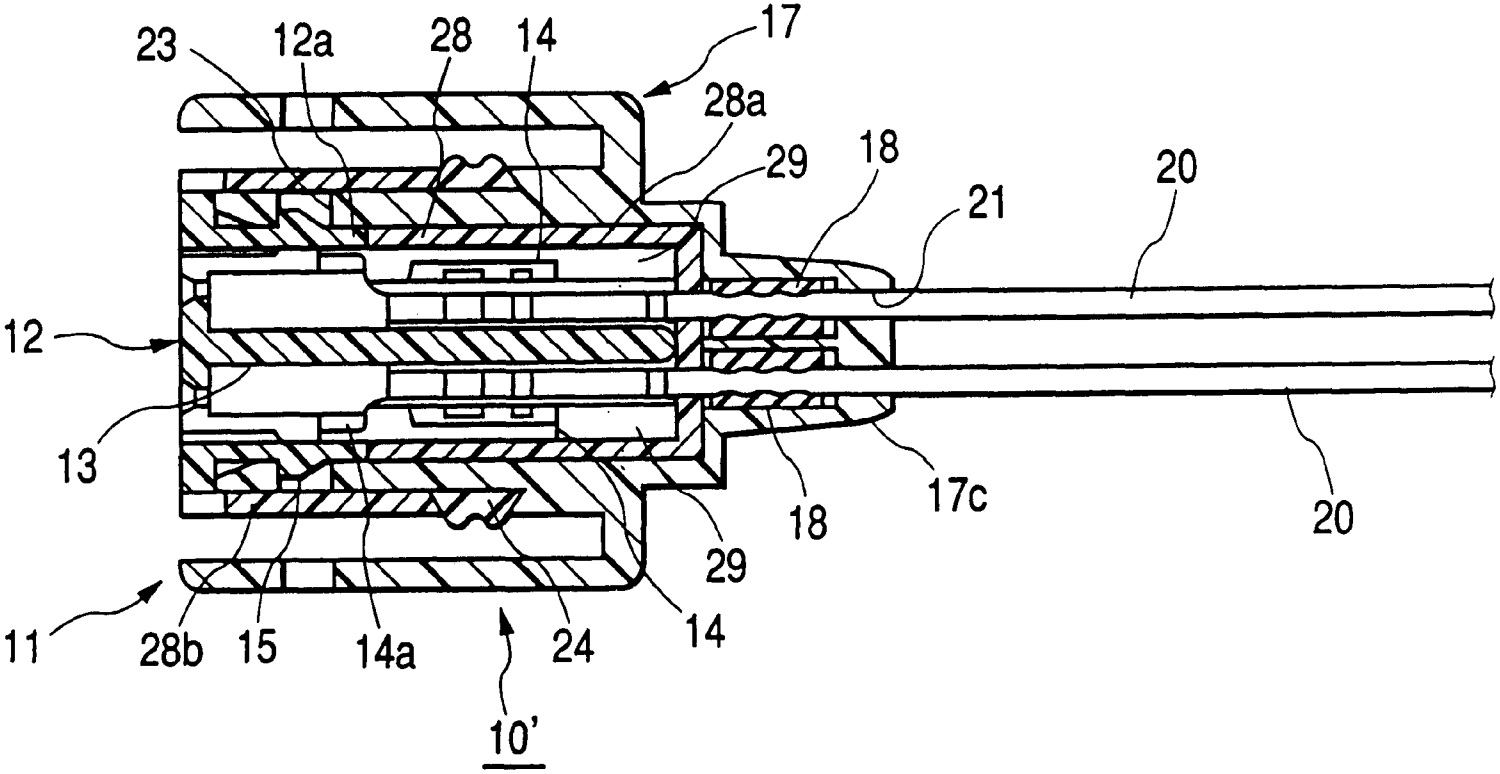
FIG. 4E is a cross-sectional view showing a state after completing the assembly of the related water proof connector.
Figure 5:
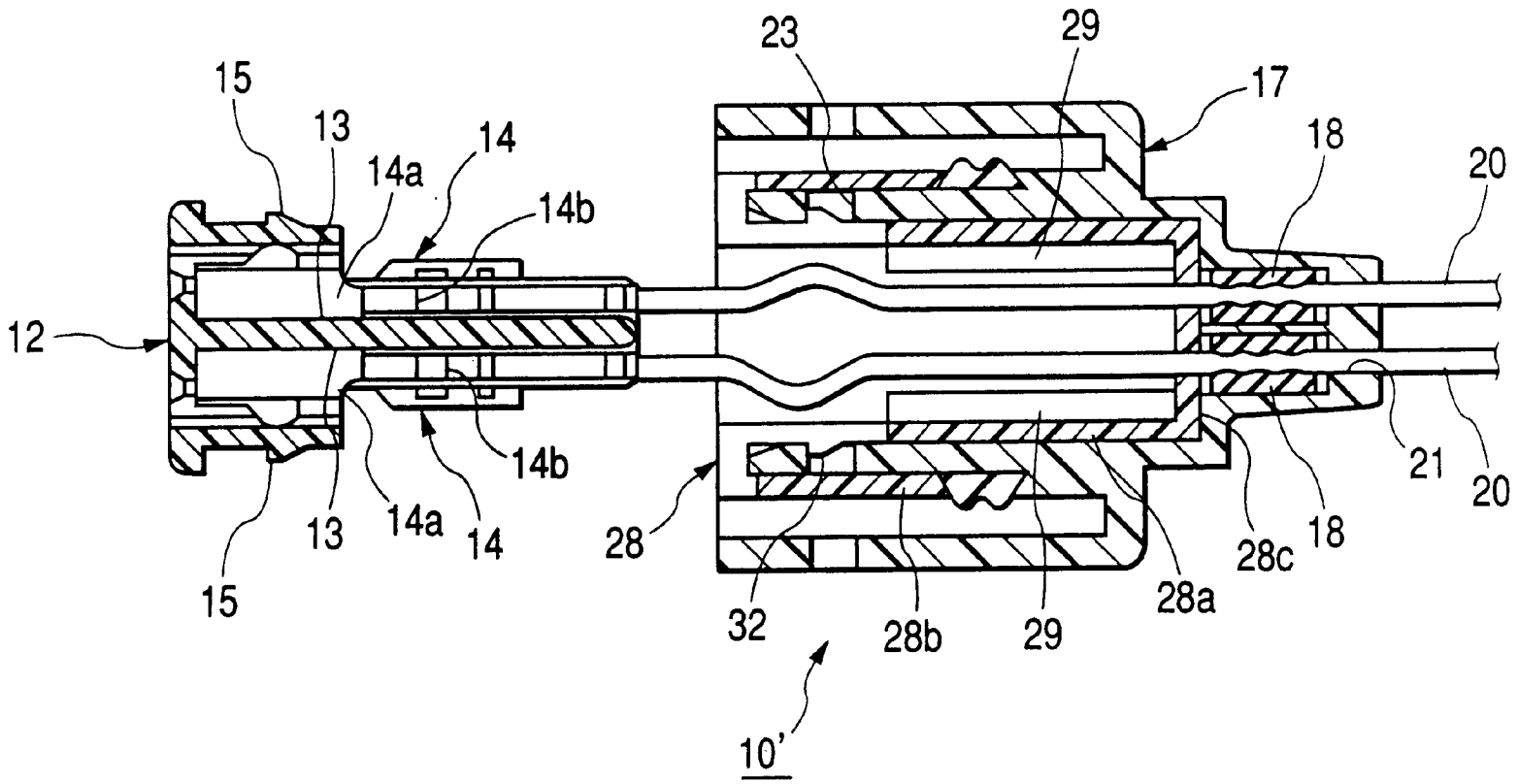
FIG. 5 is a cross-sectional view showing a state before fitting the inner housing into the spacer fitted in the inside of the outer housing of the related water proof connector.

Moreover, since the female terminals 14 are connected with the electric wires 20 by the press-connecting by the pair of the press-connecting blades 14*b* as well as the rubber plugs 18 are fixed to the female terminals 14 by pressure fixation by caulking, the connection or fixation can be enabled by an automatic machine, and thus a mass assembly of the water proof connector 10 can be achieved. Furthermore, since the rubber plugs 18 are also pressed and fixed to the female terminals 14, unlike the related waterproof connector, the portion provided with the function of preventing the fall-off of the rubber plugs 18 (the body 28*a* and the bottom wall part 28*c* shown in FIG. 2) can be eliminated in the spacer 28 for holding the water proof packing 24, downsizing of the water proof connector 10 can be achieved.

Although a plurality of the terminal chambers are formed adjacent with each other in the right and left direction (horizontal direction) of the inner housing in this embodiment, it is also possible to form the terminal chambers also in the upper and lower directions via the bottom wall similarly to the related waterproof connector. Moreover, although the case of press-connecting of the electric wires to the pressure terminals has been explained, the terminals are not limited to the pressure terminals, but this embodiment can also be adopted to the case of the pressure connection of the electric wires to crimp-style terminals.

What is claimed is:

1. A waterproof connector comprising:

a waterproof rubber plug having a through hole through which an electric wire is inserted;

a terminal to which the electric wire is connected having a clamping member for clamping one end portion of the rubber plug;

an inner housing having a terminal chamber for accommodating the terminal;

an outer housing having sidewalls for defining a chamber provided with a bottom wall, into which the inner housing is fitted;

a through hole, through which the electric wire is inserted, formed on the bottom wall so as to face the terminal chamber when the inner housing is inserted into the chamber of the outer housing; and a recess formed on the bottom wall so as to communicate with the through hole in order to accommodate the rubber plug when the inner housing is completely fitted into the chamber of the outer housing, thereby sealing the electric wire and the terminal chamber.

2. The waterproof connector as set forth in claim 1, further comprising:

a waterproof packing member attached on an outer peripheral face of the side walls of the outer housing; and a spacer engaged with the side walls to hold the packing member thereon.

3. A method for assembling the waterproof connector as set forth in claim 1, comprising the steps of:

passing the electric wire through the through hole on the bottom wall of the outer housing;

passing the electric wire through the through hole of the rubber plug;

connecting the electric wire to the terminal while holding one end portion of the rubber plug by the clamping member of the terminal;

fitting the terminal into the terminal chamber of the inner housing; and pulling the electric wire toward the bottom wall such that the inner housing is fitted into the chamber of the outer housing and thereby the rubber plug is fitted into the recess of the outer housing.

* * * * *